United States Patent [19]

Kraiss

[11] Patent Number: 4,588,544

[45] Date of Patent: May 13, 1986

[54] METHOD AND APPARATUS FOR FORMING CONCRETE ARTICLES CONTAINING ONE OR MORE PROJECTING ELEMENTS

[75] Inventor: Richard Kraiss, Laichingen-Suppingen, Fed. Rep. of Germany

[73] Assignee: Georg Prinzing GmbH & Co. KG Betonformen- and Maschinenfabrik, Blaubeuren, Fed. Rep. of Germany

[21] Appl. No.: 707,941

[22] Filed: Feb. 28, 1985

[30] Foreign Application Priority Data

Feb. 28, 1984 [DE] Fed. Rep. of Germany ..... 3407124
Jan. 22, 1985 [DE] Fed. Rep. of Germany ..... 3501845

[51] Int. Cl.[4] ..... B28B 1/00; B28B 23/00

[52] U.S. Cl. ..... 264/277; 249/144; 249/97; 425/110; 425/117; 264/278; 264/333

[58] Field of Search ..... 249/83, 96, 97, 144; 425/110, 117, 126 R, 125; 264/32, 35, 277, 333, 278

[56] References Cited

U.S. PATENT DOCUMENTS 1,555,878 10/1925 Rust ..... 249/96 X
3,315,327 4/1967 McClarney ..... 425/110
3,655,842 4/1972 Trautner ..... 425/117 X
3,729,165 4/1973 Trimble ..... 249/144
4,075,272 2/1978 Washabaugh ..... 425/126 R X

*Primary Examiner*—J. Howard Flint, Jr.
*Attorney, Agent, or Firm*—Michael J. Striker

[57] ABSTRACT

A method and an apparatus for producing concrete articles, such as shaft rings, with projecting elements such as climbing irons or stirrups, by means of an automatic inserting mechanism which removes the climbing irons from a magazine and automatically inserts them into a mold core. These climbing elements are guided automatically to a core segment and are brought into housings therein during a time interval between the ejection of a completed concrete article from the mold cavity in a first working cycle and the next following work cycle in timed overlap with carried out work steps during this time interval. This automatic process takes place while the operator withdraws and takes away a completed article from the machine at the end of a work cycle and prepares the machine for the next work cycle. This leads to equally short machine cycle times for completion of concrete articles with or without climbing elements.

81 Claims, 13 Drawing Figures

22
40
6
23
12
53
51
24
25
9
5
29
26
27
49
52
61
9
88
41
30
23a
62
66
64
89
42
36
35
24a
65
90
63
15
94
43
50
60
10
91
44
67
69
11
68
72
71
70
7
8

22
40
6
12
23
24
25
26
27
53
51
49
5
9
9
88
41
30
23a
52
67
42
89
24a
68
50
10
15
36
35
90
43
25a
61
94
64
62
66
11
91
44
26a
65
69
72
63
71
70
60
7
8

223a
151a
123h
123g
123f 187
185a
186b
186a
157
159
158
161a
160
164
181a
181b

METHOD AND APPARATUS FOR FORMING CONCRETE ARTICLES CONTAINING ONE OR MORE PROJECTING ELEMENTS

BACKGROUND OF THE INVENTION

The invention relates to a method for molding concrete articles, e.g., shaft rings, shaft necks or the like, with one or more projecting elements, particularly climbing elements, such as a climbing iron, stirrup or the like. In addition, the invention relates to a molding apparatus to accomplish this method.

A known molding apparatus of this type (German Patent No. 3,110,185) has proved very successful. It makes possible an automatic production output, that however is for the purpose of preventing repeated manual operations. An interruption occurs after the end of the working cycle, in which a concrete article is completed and pushed out over the top of the upper edge of the core form with a pusher plate and a lower sleeve by an underground arrangement of the apparatus. Following this the completed concrete article rests on the lower sleeve and is ready for transportation. In addition, a new lower sleeve must be placed on the pusher plate. In addition, insertion of individual projecting elements, particularly climbing elements, is undertaken by hand. By shaft rings with constructed heights of 500 millimeters or by cones, in which only two climbing elements are located, the climbing elements are placed in the core form by hand from above. As a rule, in order to insert the climbing elements, the worker must kneel on the pusher plate. When four climbing elements are to be cemented in, they can be inserted from above only with a great deal of difficulty. By underground machines it is then additionally necessary, that the worker climb into the cavity of the machine by steps and once therein place the climbing elements in the form segment of the core form by hand. These described methods are obviously very laborious. They are also extremely physically strenuous for the worker. These manual working steps also have a very negative on the cycle time. As a result of these manual operations, the length of time of the automatic finishing process varies greatly. Additionally as a result of the above, the automatic process must be interrupted.

SUMMARY OF THE INVENTION

It is an object of the present invention to provide a method of molding concrete articles with climbing elements which avoids the manual insertion of the climbing elements and the disadvantages associated therewith.

Pursuant to this object, and others which will become apparent hereafter, one aspect of the inventive method resides in supplying the projecting elements, particularly climbing elements, simultaneously with the transporting away of the previously finished concrete article. This has the advantage that the cycle time of the machine for completion of the concrete article without projecting elements, particularly climbing elements, needing to be brought in, is as short as completion of the concrete with the mentioned climbing elements. The time interval which was additionally necessary previously for the manual insertion of the projection elements is eliminated. Due to the periodic overlapping of the automatic supplying and inserting of the projecting elements, in particular climbing elements, within a concrete article which is to be made, the cycle time is shortened corresponding to this time period. Thereby the effectiveness of the method and also the related machine is increased. The quantity produced per unit of time is also increased. At the same time the automatic process provides reproducible products which are freed from human input by manual manipulation.

It is an additional object of the present invention to provide an apparatus for molding concrete articles pursuant to the above mentioned method. Pursuant to this object, one aspect of the invention resides in automatically operated element inserting equipment by means of which the projecting elements, particularly climbing elements, can be inserted automatically in the underground area of the form segments of the form core. At the same time in a free accessible area of the apparatus, the operator removes the completed concrete article at the end of the cycle time and the remaining manual preliminary steps for the performance of the next work cycle are begun, particularly, when manufacturing with a lower sleeve, the next lower sleeve is inserted. Thereby the total cycle time of the apparatus is reduced compared with the cycle time necessary when single elements, particularly climbing elements, are manually inserted. Additionally advantageous is that the operator is no longer required to undertake these laborious, extremely strenuous manual tasks. Moreover, the variabilities in time associated with the manual operations by the operator are removed. In a further embodiment of the apparatus a pick-off attachment is provided that can manipulate either only one element, particularly a climbing element, or a number of elements simultaneously. Each pick-off attachment can be provided with at least one magazine of climbing elements. In a further embodiment the pick-off attachment has at least one mounting, each mounting being provided with its own magazine of climbing elements. Alternatively, two corresponding projecting mountings can be provided with a single magazine and the pick-off attachment is controlled during the removable of an element from the magazine.

In yet another embodiment the pick-up attachment is formed as a gripping device which grabs the elements with a closable clamp. In this manner, the climbing elements are automatically suppliable not only as the customary climbing iron but also as stirrups. Stirrups are customarily made of light metals, e.g. aluminum. Because of its low weight there exists the risk that after insertion in a receptacle of the core segment by means of a push-out member and the return movement of this member, the inserted stirrup can be displaced. This is prevented by the core segment being provided with a clamping device which when activated holds the inserted stirrups and the gripping device only then lets go its grip on the stirrups. The stirrups can be held in the area of their anchoring end, which will later be situated in the concrete. Climbing irons can also be handled in a similar manner. Constructing the element inserting equipment as a gripping device results in a simpler, lighter, and more cost-effective device. One requires only one embodiment for both described types of climbing elements.

In yet another embodiment of the apparatus, the magazine and/or the gripping device and/or a sliding carriage are angularly positionably provided in relation to the form core within a diametral plane of the form core. With this it is guaranteed that the named articles can be set with regard to the angle when producing concrete articles with different nominal diameters. This is similarly guaranteed when for example any of the projecting elements, in particular climbing elements, are not radial in relation to the middle axis of the form core but rather are to be inserted so as to project parallel to one another.

In still a further embodiment each magazine has its own element-guiding arrangement. This then provides, when the element inserting equipment finds itself in its inserting position, a connection between the magazine on one side and the molding apparatus on the other side, whereby the elements are pushed together in the element-guiding arrangement over at least one element length so as to abut and sequentially follow one another, when the gripping device is activated. The gripping device fulfills two duties at one time. One purpose which it fulfills is the taking out of the lowermost elements present in the magazine's stack, these being the elements that are pulled out the magazine stack and moved into the element-guiding arrangement. The other purpose which the gripping device fulfills is to push the elements within the element-guiding arrangement forward one element length, so that on the forward end of the guiding arrangement an element is pushed out through a discharge opening and out through the opening in a corresponding housing of the core segment.

The so-structured element inserting equipment is extraordinarily simple. It can be made with welded structures at small expense. Thereby every element-guiding arrangement is regulated in length so that these and also the magazines are not distorted in length.

In still another embodiment the element-guiding arrangement has two angle moldings which allow one to see inside the element-guiding arrangement. This is beneficial to allow for inspecting and also provides for a good and quick access for example for cleaning purposes or in case of disturbance or for similar reasons.

In another embodiment a twin operating arrangement of elements, particularly climbing irons, allows the elements to be simultaneously inserted together into the core segment through the two assemblies in an expensive, space saving and a controlled technology uncomplicated manner. There are only two functions to control, namely the movement of the element inserting equipment into the inserting position and back, and the activation of the single tripping device located on each magazine so as to carry out the double operation of removing the lowermost element out of their respective magazine and to push an element into the element-guiding arrangement so that at the same time another element is pushed out of the other end of the guiding arrangement and inserted in the core segment. This is accomplished by a swinging operation which makes its possible by simple means to provide an attachment of the assembly on form cores of differing diameters.

In yet a further embodiment of the invention, the apparatus has a plurality of housings and magazines in an assembly, and the assembly is attached to a sliding carriage. This embodiment is particularly advantageous for inserting a plurality of elements, particularly stirrups, under one another along a generatrix of the mold core. This embodiment is particularly simple, cost-effective and space saving.

In still another embodiment the apparatus has an inserting arrangement with a plurality of housings in a common running line of the core segment, and a single magazine along with the attached element-guiding arrangement is liftably held on a carrier by means of a lifting drive. This embodiement is the lightest, smallest and least expensive with regard to material required and floor space required. This single magazine arrangement can achieve the desired result despite the required larger number of control functions and frequent necessary refilling of the magazine.

In a further embodiment the lower end of the magazine is provided with hooks, and the magazine is also provided with a translation drive. This form of the pick-off attachment is to a large degree operationally secure, thereby exceptionally spacesaving, simple and inexpensive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
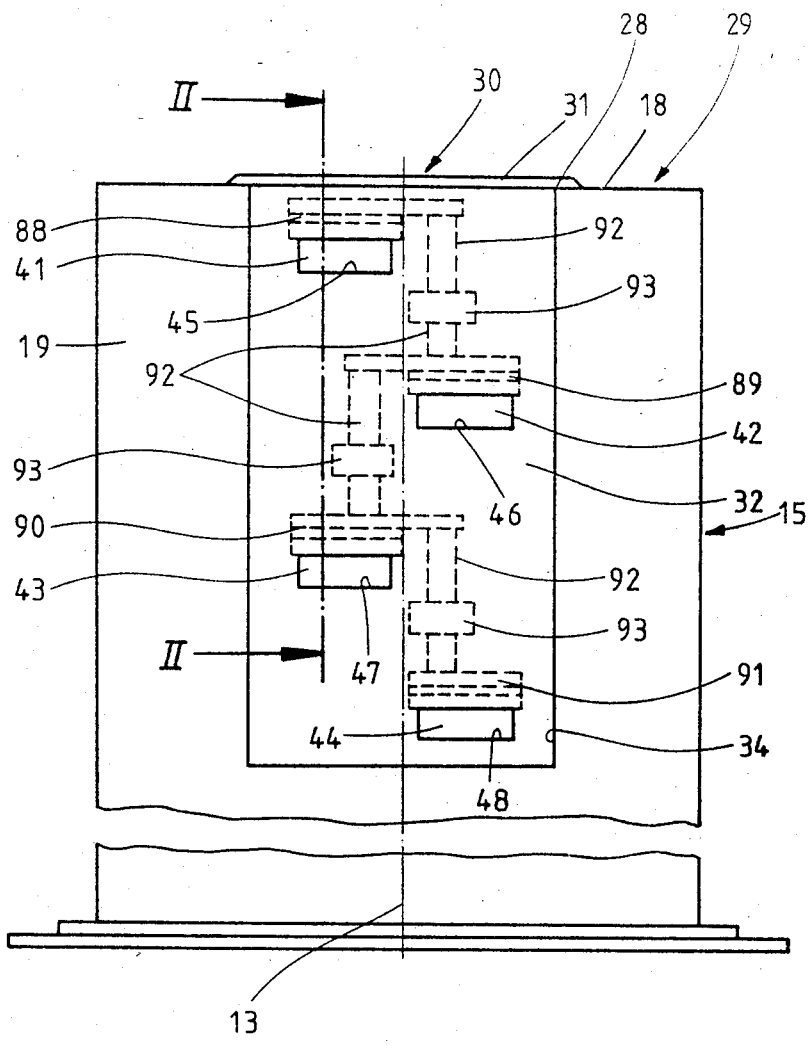
FIG. 1 is a schematic side view of the mold core of a molding apparatus for molding concrete articles pursuant to a first embodiment of the invention.

FIGS. 1 through 5 illustrate a first embodiment of a molding apparatus. The illustrated molding apparatus is a component of an underground machine 10 shown in a schematic partially broken representation. The underground machine has a working area 11 located beneath the floor level 9, in which area are located supports 7 and 8 fastened to the ground. The underground machine 10 serves with the illustrated molding apparatus to mold concrete articles, in particular shaft rings, shaft necks, well rings, passage rings or the like. In the drawings the number 12 illustrates a shaft ring formed by means of the molding apparatus, as they are individually described in for example DIN 4034. They consist of a ring wall element with a predetermined inner diameter and outer diameter, whereby the bottom outer face and the top outer face are provided with notches 5 and 6 which are formed in the molding apparatus to have corresponding cylinder form. The notches 5 and 6 allow a plurality of such concrete articles 12 to be connected in a form-locking manner. Every concrete article 12 has a tubular form with uniform wall thickness. Further details of such forming apparatuses are described in particular in German Patent No. 3,110,185, this reference is expressly made in order to remove unnecessary repetitions. This applies equally for the functional operational and the work cycle procedure during the molding.

A portion of the molding apparatus is a mold core 15, which is provided so that during the molding of the concrete article 12 a plurality of projecting elements of a desired type can be cemented into the concrete article 12 from the inside. In the illustrated example the collective elements are climbing irons 23 through 26. The term "climbing iron" used here encompasses all possible forms and constructions of such elements, and serve the function of climbing and make it possible to pass through a shaft constructed out of the connected together concrete articles 12. The term "climbing iron" covers the customarily characterized normal climbing irons and also heavier and larger safety climbing irons, e.g. made from cast iron, as well as the climbing elements traditionally characterized as stirrups. German Patent No. 3,110,185 is also referred to to this extent.

The mold core 15 is somewhat hat-shaped. It is hollow on the inside and is exchangeably fastened on a central shaker 14. The central shaker 14 rests on a foot plate 16. On its inside the mold core 15 has a, for example, welded-in plate 17, with which the mold core is placed and fastened to the central shaker 14. The plate 17 is for example formed as roughly three-quarters of a circle. The mold core 15 is in this instance for example round, this however is not mandatory. The mold core has a circular shaped lid 18 and a cylindrical core wall 19 which extends downward to the foot plate 16.

The molding apparatus further has an outer mold jacket 22 as well as a lower sleeve 27 and an upper sleeve 40 that are related.

Figure 2:
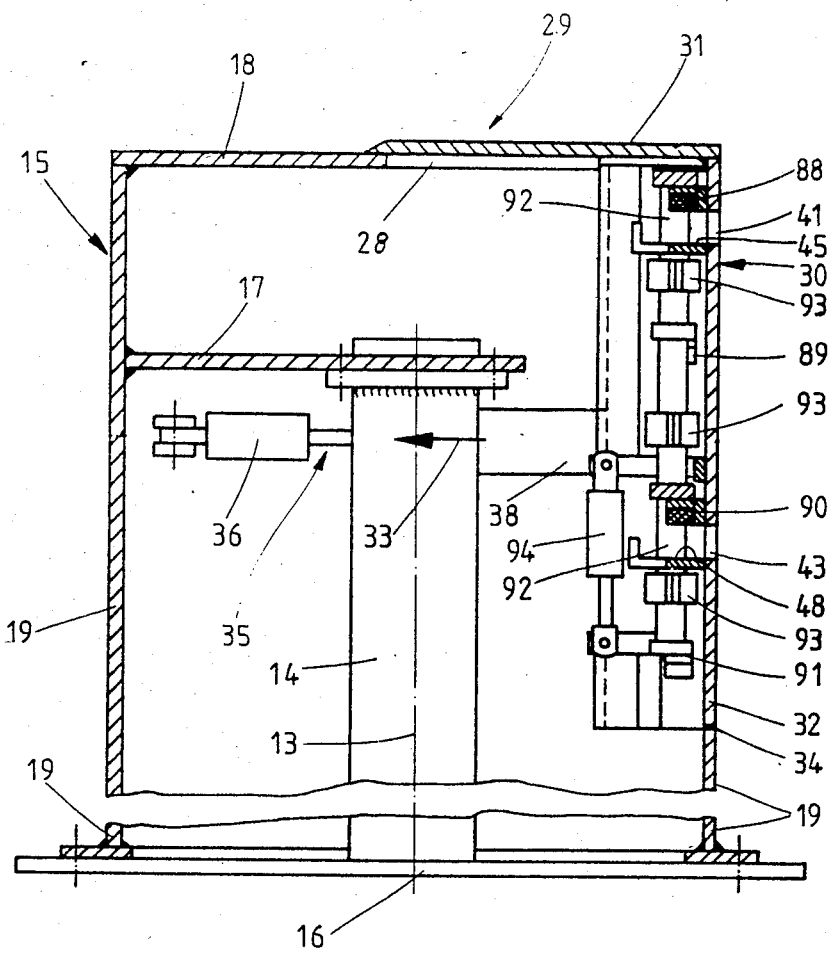
FIG. 2 is a longitudinal section of the mold core along the line II—II in FIG. 1.

The mold core 15 has a fit-in device 29 by means of which, during the molding process, at least one climbing iron, but preferably several climbing irons at the same time, e.g. for climbing irons 23–26 or 23*a*–26*a*, can be cemented from within into the concrete article which is to be formed. The fit-in device 29 comprises a core segment 30 which is here constituted by a cover portion 31 and a wall portion 32. The cover portion 31 is somewhat larger than the cover cut-out 28 which, in the condition of the cover portion 31 shown in FIG. 2, is overlapped in a sealing-type fashion on three sides which substantially form a U. The rest of the cover 18 which comprises the cut-out 28 is mounted on the core wall 19, being in particular welded thereon or being instead integral therewith so that this rest of the mold core 15 is thereby strengthened and reinforced deformation in the region of the cover 18, particularly deformation of the core wall 19.

The wall portion 32 of the core segment 30 has the form of a portion of the cylinder wall. The cylindrical core wall 19 is, in keeping with the wall portion 32, provided with an identically formed portion 34, which, inside of elevation according to FIG. 1, is of substantially U-shape, extending from the top downwardly. In a side view or section (FIG. 2), the core segment 30 proves to be of substantially angle shape. In comparison with the rest of the mold core 15, the core segment 30 constitutes an independent element, together with the cover portion 31, that is welded to the upper end of the wall portion 32. The core segment 30 is, in relation to the mold core 15, adapted for movement with respect to the mold core 15 out of the shaped contours thereof (FIGS. 1–4) horizontally inwardly in the direction of the arrow 33 into a release position according to FIG. 5, and in the opposite direction to arrow 33, back into the closed position shown in FIGS. 1–4. If the core segment 30 is moved in the direction of the arrow 33 into the release position, then the wall portion 32 leaves the cylindrical shape contours of the core wall 19. Furthermore, the cover portion 31 is displaced leftwardly in FIG. 2 on the remaining portion of the cover 18. The cut-out 34 in the core wall 19 is thereby exposed. Climbing irons 23–26 or 23*a*–26*a* molded in situ during the shaping process are thereby freed from the core segment 30 so that removal of the form work of the finished concrete article with the climbing irons 23–26 or 23*a*–26*a* incorporated at the same time therein can take place upwardly, or alternatively by a not-shown embodiment downwardly, by the relative displacement between the concrete article 12 and the mold core 15. In the closed position of the core segment 30 as shown in FIGS. 1 to 4, this merges substantially steplessly but above all without gaps and in a sealing-type fashion and to the rest of the mold core 15, completing the shape contours predetermined thereby.

The fitting device 29 has for each climbing iron 23–26 or 23*a*–26*a*, which is to be cemented into place, a housing 45–48 which is provided on the wall portion 32 and which has in detail a suitable supporting surface with centering provision in the region of aperture 41–44, which serves to correctly position the housing for a climbing iron which is to be cemented into position and which is to be incorporated from outside through the apertures 41–44, all of which occurs prior to the forming process.

The fit-in device 29 has furthermore for each aperture 41–44 and housing 45–48 a clamping device 88–91, all of which are combined via round guide rods 92 to produce a vertically upwardly and downwardly movable unit. The round guide rods 92 are adapted for vertical upwards and downwards displacement in divided plane bearings 93. Common to all clamping devices 88–91 is a single clamping drive 94 in the form of a hydraulic or pneumatic working cylinder which on the hand engages the round guide rods 92 and the other hand supports the core segment 30, in other words, like the clamping devices 88–91 is likewise a part of the core segment 30.

For horizontal translatory movement of the core segment 30 in the direction of the arrow 33 and back, a drive device 3f5 is provided, which for example has two individual translatory drives in the form of hydraulic or pneumatic working cylinders 36, both of which extend substantially parallel with each other in the direction of the arrow.

Together with the relevant housings 45–48 and the clamping devices 88–91 associated therewith and the clamping drive 94 which is common to all, the complete core segment 30 can be removably and exchangeably mounted as a complete element on the remainder of the mold core 15.

Figure 3:
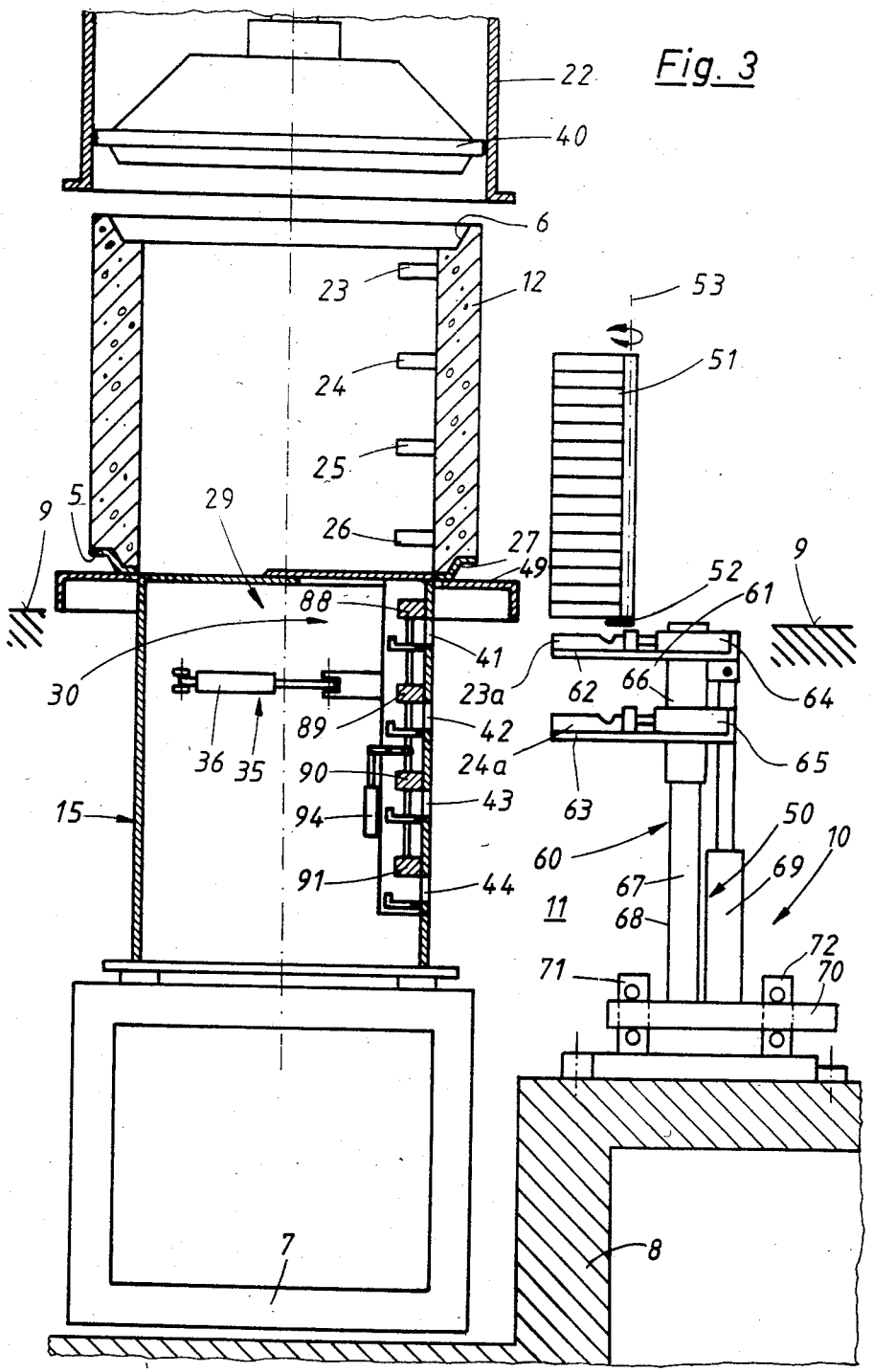
FIG. 3 is a partially sectioned side view of a portion of a machine with a molding apparatus and the mold core of FIG. 1, in a position after ending of the automatic work cycle in which the core segment is in its closing position, ready for receiving the climbing irons to be automatically inserted, before the start of the next automatic work cycle.
Figure 4:
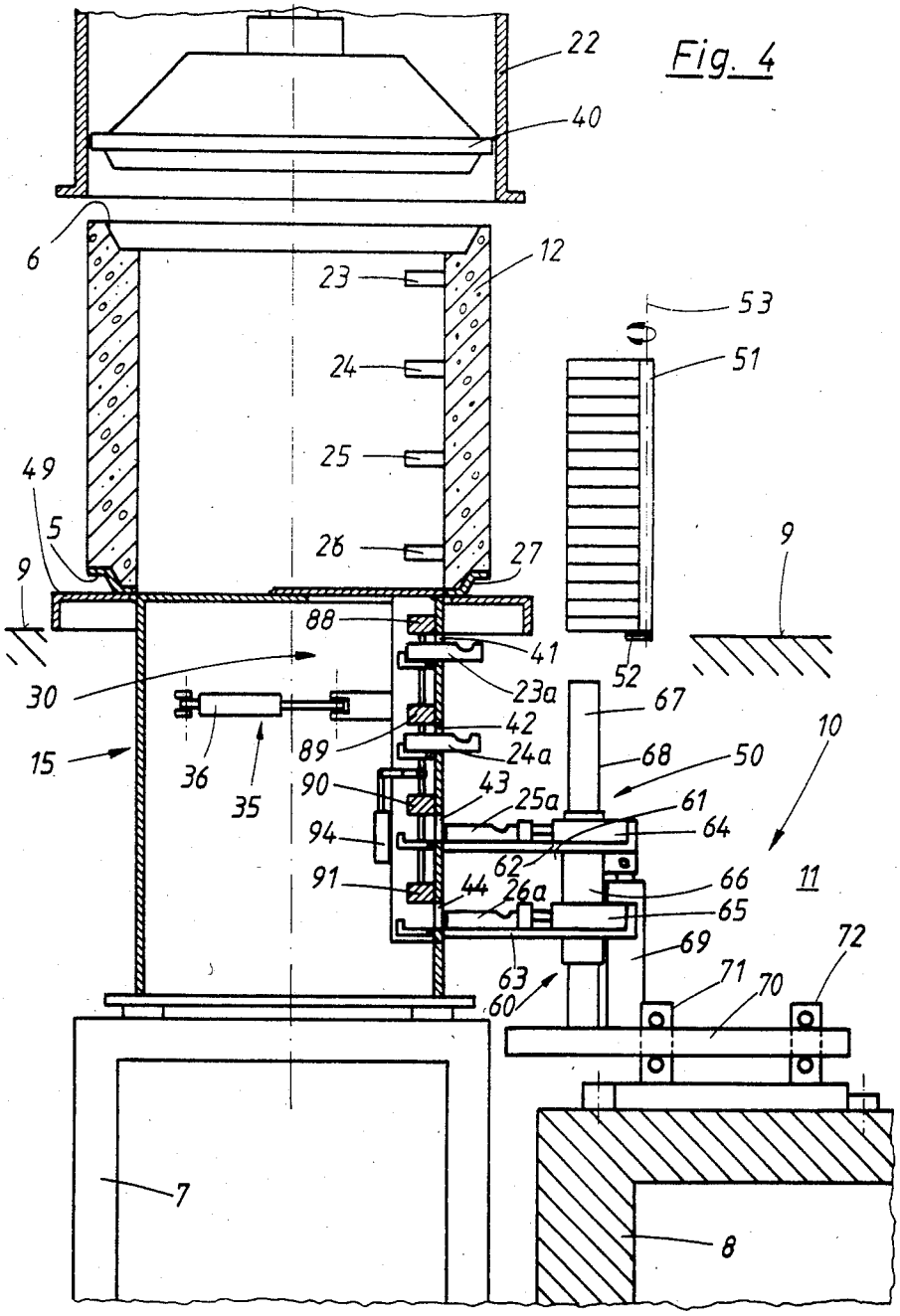
FIG. 4 is a partially sectioned side view corresponding to FIG. 3, in which the invention is in a position of the automatic insertion of climbing irons in the mold core.

The described underground machine 10 according to the first embodiment in FIGS. 1–5, is provided within the working area 11 with an automatically operated element inserting apparatus 50 that is integrated with the underground machine 10. It is placed on the support 8 and is illustrated only in FIGS. 3 and 4. The element inserting apparatus 50 is at least arranged with a heighth substantially equal to the heighth of the mold core 15, and is also arranged outside of the molding apparatus in the laterally neighboring working area 11. Thereby the element inserting apparatus 50 finds itself at the side of the mold core 15, where the core segment 30 with the apertures 41–44 and the housings 45–48 are located, to the right of mold core 15 as seen in FIGS. 3 and 4.

The element inserting apparatus 50 is provided with at least one magazine 51, which is indicated schematically, in which the individual climbing irons to be cemented in are held in a stack manner ready to be extracted. The magazine 51 is located above the ground level 9, in this way it is easily accessible by the operator of the underground machine 10 so that the magazine 51 can be refilled with climbing irons in the operator's free time between the automatic production working cycles. This refilling task is completely independent from the automatic production cycle. As is schematically indicated by a base 52 and a shaft 53, at least one magazine considered within a diametral plane of the mold core 15, is angularly adjustable for an angular adjustment when different nominal sizes are used. Another possible adjustment for such climbing irons is that instead of, as in the above manner, cementing the climbing irons radial to the middle axis of the core 15, they can be cemented in parallel to the axis. The removal of the stored climbing irons from the magazine 51 can always follow from the lowest region of the magazine. By removal of the bottommost climbing iron, the climbing irons located above it automatically move downward.

The element inserting apparatus 50 has at least one pick-off and inserting device 60 by means of which one climbing iron or simultaneously a plurality of climbing irons are removable from the magazine 51, the climbing irons are adjustable into a correct position for the respective housings 45–48 in the core segment 30 of the mold core 15 in which they are to be later inserted in, and by means of which the climbing irons are insertable from the outside of the mold core 15 into the corresponding housings 45–48. A portion of this at least one pick-off and inserting device 60 is at least one pick-off attachment 61 which engages with the at least one magazine 51 to grasp at least one climbing iron therein and to remove it and insert it properly adjusted in the corresponding housings 45–48 of the core segment 30. The illustrated pick-off attachement 61 can be formed, as made clear in the embodiment in FIG. 3, so as to simultaneously remove two climbing irons **23*a* and 24*a* from the magazine 51 and as previously described insert them through the corresponding apertures 41 or 42 of the core segment 30 into the there located housings 45, 46. It is understood that instead of this simultaneous, paired handling of the climbing elements, the pick-off attachment 61 can also formed so that, for example, only one climbing iron is handled or three, four or more climbing irons are handled simultaneously in the explained manner. The illustrated pick-off attachment 61 can be associated with two correctly positioned magazines 51 so that by a single movement toward the magazine a climbing iron is removed simultaneously out of both magazines 51. The pick-up attachment 61 is provided with a holder 62 and 63 and a corresponding ejecting apparatus for each climbing iron 23*a*, 24*a* (FIG. 3) or 25*a*, 26*a* (FIG. 4). The ejecting apparatus can be formed for example as a hydraulic working cylinder 64 or 65. The holder 62, 63 with associated working cylinders 64, 65 are aligned with respect to one another, namely in the same step form in the same orientation as the apertures 41, 42 in the core segment 30. Both are therefore within the diametral plane of the mold core 15 in angular relationship to each other and at the same time in orientation with the longitudinal central axis of the mold core 15. The holders 62, 63 are so aligned with their respective cylinders 64, 65 on a carrier part 66 which is guided on a carrier 67 having a guide 68 which is at least somewhat parallel to the longitudinal middle axis of the mold core 15, the carrier part 66 also being movable by means of a corresponding positioning drive in the form of for example hydraulic working cylinders 69. The holders 62, 63 are angularly adjustable in position on the carrier 67 within the diametral plane of the mold core 15 in order to accommodate differing nominal diameters of concrete articles 12 to be produced. At the lower end of the carrier 67 runs a sliding carrige 70 that is transverse, particularly perpendicular, to the longitudinal middle axis of the mold core 15. The sliding carriage 70 is movably provided in suitable manner, e.g. by means of two indicated bearing blocks 71, 72, and is movable in the direction of the mold core 15 into an inserting position, shown in FIG. 4, and back out of the area of the molding apparatus into the waiting position shown in FIG. 3, by means of a drive, particularly in the form of a hydraulic working cylinder. The carrier 67 is a fixed component of the sliding carriage 70, so that through the movement of the sliding carriage 70 between the inserting position and the waiting position, the pick-off attachment is brought into concerned position. As is indicated, the sliding carriage 70 can be with respect to the mold core 15, within a diametral plane of the mold core 15, angularly adjustably attached to the support 8**, in order to make possible an adjustment for differing nominal diameters of other desired adjustments.

According to another, not illustrated embodiment, the pick-of attachment is provided with at least one gripper that securely clamps a grasped climbing iron by means of closable clamps, and after insertion in the proper corresponding housing 45–48 of the core segment 30 releases the climbing irons by opening of the clamps. The gripper thereby grasps each climbing iron on an end that is later to be anchored within the concrete of the concrete article 12. The gripper is thereby so controlled that the clamps are first opened after insertion of the at least one climbing iron when before this each inserted climbing iron is held without slipping within its respective housing 45–48 through application of the provided clamping devices 88–91. Here, opposite to the illustrated embodiment, the working cylinder 64, 65 is dropped out, whereby the holders 62, 63 are formed as grippers with gripper backs. This embodiment is advantageous to use for climbing elements formed as stirrups, which today are customarily made of aluminum and have a relatively light weight. Particularly, this embodiment overcomes the difficulty with the con structions of the pick-off attachment 61 in FIGS. 3 and 4, wherein the stirrups would slide within their housings 45–48 by return movement of such a pick-off attachment 61 into the waiting position. The same embodiment is also advantageously suited for the automatic insertion of climbing irons 23–26, **23*a*–26*a* which are likewise clamped on the anchoring end by means of the grippers. The removal of the working cylinder 64, 65** reduces expenses and costs. Above all such a constructed pick-off attachment is well suited unaltered on the one hand for insertion of climbing irons and on the other hand for insertion of stirrups in a like manner.

The element inserting apparatus 50 makes it possible to bring in the single climbing irons, e.g. the climbing iron **23*a*, 24*a* in the position according to FIG. 3, in the time interval between an ending work cycle, wherein the removal, preferably discharge, of the completed concrete article 12 out of the mold cavity takes place, and the next following new working cycle, in timed overlap with work steps in the this interval which automatically guide the core segment 30, and into the housings 45–48. This can take place while the concrete article 12 completed in a previous work cycle, as shown in FIG. 3 in its discharged position, is transported away and a new lower sleeve for the next following to be produced concrete article is placed on a discharge plate 49. Thereby, in the meantime, one can bring in the climbing irons one at a time or in groups while at the same time guiding the core segment 30, and bring the climbing irons into the housings 45–48 of the core segment 30. It is advantageous to remove the single climbing irons 23*a*–26*a* from the magazine 51 prior to the ending of a work cycle through discharge of the finished formed concrete article 12, during the temporary overlapping therewith for the next concrete article to be produced, and to align the climbing irons relative to the housings 45–48 of the core segments 30**, and to finally hold the climbing irons ready in this alignment for later guiding in and inserting.

Figure 5:
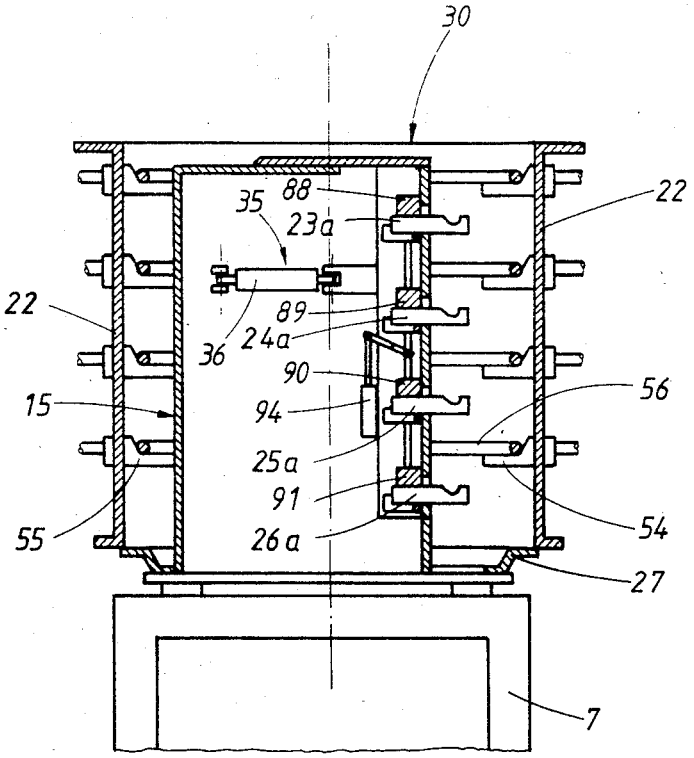
FIG. 5 is an axial section of portions of the molding apparatus according to FIGS. 3 and 4, in position in which the climbing irons are inserted in the core segment and are secured therein by means of a clamping means, wherein the core segment is moved to the left in a release position relative to the position in FIGS. 3 and 4, and the molding apparatus is in a working position after inserting the reinforcing rings and before the introduction of concrete into the mold space.

FIG. 3 illustrates a condition during the holding process wherein the complete formed concrete article 12 along with the discharge plate 49 and the lower sleeve 27 is pushed out upwardly from the mold cavity to the heighth of the upper edge of the mold core 15 corresponding to the floor elevation 9. The core segment 30, that was guided into the release position during discharge, as is also shown in FIG. 5, is immediately after discharge of the concrete article 12 returned in the closed setting shown in FIG. 3 in order to avoid hanging up and tearing out of the cemented in climbing irons 23–25, the clamping devices 88–91 are thereby open, as shown.

Already during the working cycle, in which the discharged concrete article 12 is produced as shown in FIG. 3, the element inserting apparatus 50 is prepared in the loading position illustrated in FIG. 3, namely, the pick-off attachment 61 as taken during this time new climbing irons **23*a* and 24*a* from the at least one magazine 51. The pick-off and inserting device 60 finds itself thereby in the proper alignment for inserting the climbing irons 23*a*, 24*a*. FIG. 3, however, illustrates only the waiting position. As soon as the core segment 30 moves into the illustrated closed position, the sliding carriage along with the carrier 67 and the pick-off attachment 61 is moved horizontally toward the core segment 30 out of the waiting position into the inserting position, to the left in FIG. 3. The holder 62 then rests at the elevation of the aperture 41 and the there situated housing 45, and the holder 63 rests at the elevation of the aperture 42 with the there situated housing 46. At this time, the working cylinder 64, 65 are activated thereby the climbing irons 23*a* or 24*a* from their respective holder 62 or 63 downward through the aperture 41 or 42 and through the corresponding housing 45 or 46. After this the sliding carriage 70 again returns to the waiting position shown in FIG. 3. After that the pick-off attachment 61 takes two more climbing irons 25*a*, 26*a* from the magazine 51. After this the pick-off attachment 61 is driven by activation of the working cylinder 69 into the corresponding aligned position so that now the holder 62 is aligned with the aperture 43 having the housing 47 and the other holder 63 is aligned with the aperture 44 having the housing 48. Then the sliding carriage 70 is slid by its own drive out of the waiting position, to the left in FIG. 4, into the there shown inserting position. Through activation of the working cylinder 64, 65 the climbing irons 25*a*, 26*a* are pushed out and placed in the housing 47 or 48. After this the sliding carriage 70 is once again driven back from the inserting position into the waiting position illustrated in FIG. 3. Therewith is mainly the task of the element inserting apparatus 50 fulfilled. This can now be renewed during the remaining operations of the underground machine 10, for example be brought into the loading position as is shown in FIG. 3**.

The described automatic insertion of the individual climbing irons **23*a*–26*a* follows temporarily overlapped during the time during which the operator of the underground machine 10 transports away the concrete article 12 which is discharged upwardly on the lower sleeve 27 at the end of the first work cycle and places a new lower sleeve 27 on the discharge plate 49. The mechanical means of the element inserting apparatus 50 which undertakes inserting the climbing irons 23*a*–26*a* proceeds rapidly, reproducibly consistently and relieves the operator from these otherwise laborious and extremely strenuous activities which are required by manual insertion of the climbing irons. For this reasons, up to now, this manual inserting had a disadvantageous effect on the station time and thereby on production speed. Then through these manual activities, large variable times for the automatic operation are produced, whereby the automatic manufacturing cycle must also be interrupted. Now it is achieved that in the working area 11, namely underground, the next climbing irons 23*a*–26*a* are already automatically brought into the mold core 15, and while the operator is still engaged with this task, at the end of the work cycle the completed and upwardly discharged concrete article 12 is removed and the next lower sleeve 27 is placed on the discharge plate 49. The removing of the concrete article 12** and the placing of the next following lower sleeve can also be automatically carried out.

Proceeding from the position shown in FIG. 4, the element inserting apparatus 50 is again driven to the right into the waiting position, thus each individual clamping device 88–91 is immediately set in motion by activation of the clamping drive 94, and thereby each climbing iron 23a–26a, which is brought into the corresponding housing 45–48, is clamped and securely held in this position. The next work cycle is begun by engaging the underground machine 10 simultaneously with activating the clamping drive 94 or at the latest after the resulting clamping. The core segment 30 is moved out of the contact position into the disengaged position shown in FIG. 5, by activation of the translation drive 36. Then the passage is clear for the discharge plate 49 with a new lower sleeve 27 over the mold core 15 to be lowered toward the bottom. Thereafter the mold jacket 22 is driven downward and sits on the new lower sleeve 27. After this individual reinforcement holders 54, 55 are introduced in a customary manner one after the another by timed relay control, through the mold jacket 22 into the mold cavity. Then a reinforcement ring 56 is thrown in from the top so as to fall on the lowermost reinforcement holder 54, 55 and in this manner is automatically centered within the mold cavity. Subsequently, in a similar manner, the next upper located reinforcement holder is driven in and a reinforcement ring is centered thereon. This process is carried out until the uppermost reinforcement holder and reinforcement ring are in position. The automatic work cycle is interrupted to allow insertion of the reinforcement rings 56 since these operations are manually performed. Thereafter, by activation of a further start button of the underground machine 10, the automatic process continues, and indeed proceeds from the position of the molding apparatus illustrated in FIG. 5. The translation drive 36 is now activated and thereby the core segment 30 is moved out of the disengaged position according to FIG. 5 into the contact position. It is understood that the singular reinforcement rings are so oriented that during the sliding of the core segment 30, the climbing irons 23a–24a held therein do not come in contact with the reinforcement rings. Then a not-illustrated feeding installation is provided in a known manner and pours concrete from above into the mold cavity. The concrete is then compacted by vibration of the switched on central shaker 14. After this the concrete feeding installation is driven back. Then the upper sleeve 40 is moved into the mold cavity from above. The upper sleeve 40 is hydraulically pressed in and under simultaneous vibration forms the upper notch 6 of the concrete article 12. When the pressing process of the upper sleeve 40 is ended the clamping device 94 is activated causing all of the clamping devices 88–91 to be moved upwardly into their open position. The clamping strength is now deployed on the climbing irons 23a–26a so that subsequently by activation of the translation drive 36, the core segment 30 can be moved out of the contact position into the disengaged position shown in FIG. 5. Thereby, the cemented climbing irons 23a–26a, which project inwardly over the inner jacket of the completed concrete article 12, are freed. The opening of the mold can then begin. First the mold jacket 22 is driven upward, while the still downwardly pressing upper sleeve 40 acts as a holding device. Next the upper sleeve 40 is lifted off. Then the completed concrete article is discharged upwardly to the floor level 9. To this point a position as indicated in FIG. 3 is given. During the fabrication of the concrete article the pick-off attachment has already taken two more climbing irons 23a, 24a from the magazine 51 and is situated in the waiting position illustrated in FIG. 3. As soon as the completed concrete article 12 reaches the upper end position by discharge, the core segment is again moved into its contact position as illustrated in FIG. 3 by activation of the translation drive 36. With the discharge of the completed concrete article and the movement of the core segment 30 into the contact position, the working cycle is completed.

A second embodiment of the invention is illustrated in FIGS. 6 through 9. In these figures, any parts which correspond to the first embodiment are indicated by the same numeral increased by 100. This is done so that without repetition of the description of the first embodiment, reference is made thereto.

Figure 8:
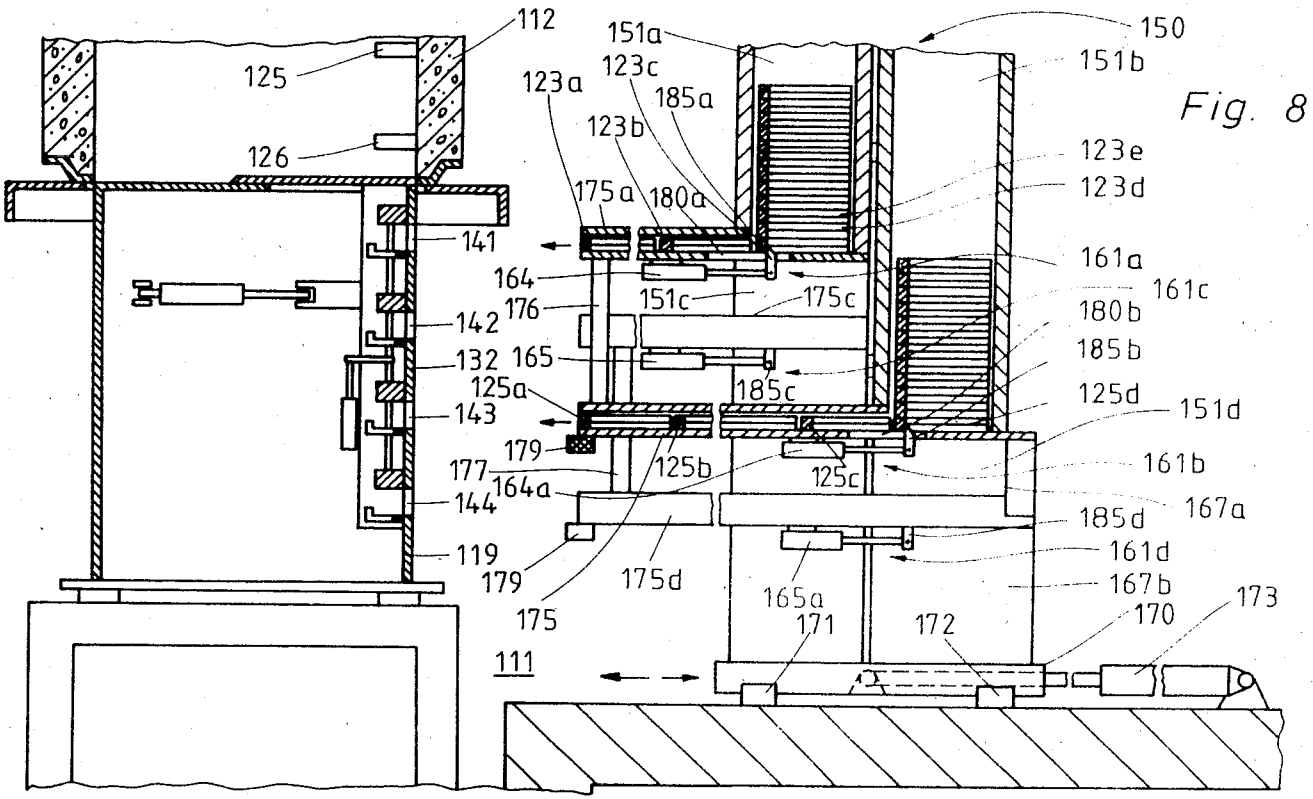
FIG. 8 is a partially sectioned side view of a portion of a machine with a molding apparatus and a mold core, similar to FIG. 3, with the element inserting apparatus in a position before the insertion of the climbing irons, pursuant to the second embodiment.

The construction in FIG. 8 corresponds at least essentially to those constructions disclosed in FIGS. 3 and 4 of the first embodiment. The second embodiment distinguishes itself from the first in that the element inserting apparatus 150 has a separate magazine 151a, 151b, 151c and 151d for each individual aperture 141–144 in the wall section 132, the magazines function in two operations and are displaced corresponding to FIG. 1. All of the magazines 151a–151d are provided substantially perpendicular.

As with the first embodiment, the individual apertures 141–144 are grouped to a two-step arrangement in the second embodiment (FIGS. 6–8), whereby one step line is advanced through the apertures 141, 143 which are over one another and run along a jacket line, and a second step line through the apertures 142, 144 which are provided over one another and along a jacket surface line. The last mentioned openings are displaced from the first mentioned openings by a step heighth in the vertical direction.

According to the second embodiment, for the first step line having the housings with apertures 141, 143, two magazines 151a, 151b are provided that belong to one stuctural component and are thereby arranged behind one another along a somewhat radially running line. This structural component of the magazines 151a, 151b is held on a lowerly oriented sliding carriage 170 by means of a lower carrier 167a.

The other step line, characterized by the apertures 142, 144, has the two other magazines 151c, 152d corresponding to it, which likewise belong to a second structural component and also in a similar manner are provided behind one another and are held on a lowerly located sliding carriage 170 by a carrier 167b.

Figure 7:
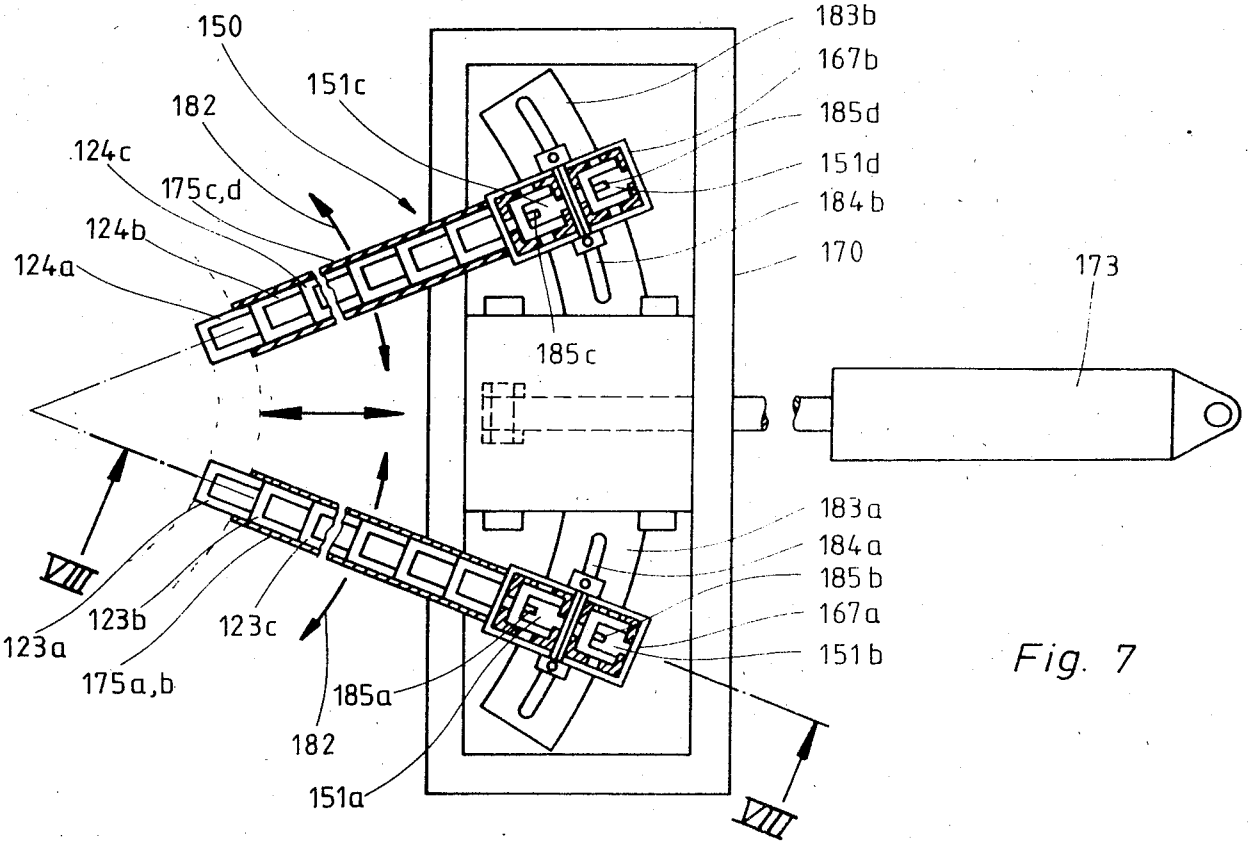
FIG. 7 is a top view of the element inserting apparatus of FIG. 6 in the direction of arrow VII.

Each individual magazine 151a–151d has its own element-guiding arrangement 175a or 175b or 175c or 175d, all of which are substantially horizontal and thereby perpendicular to the vertical axis of the respective magazines 151a–151d. At the right end, as seen in FIGS. 7 and 8, of each element-guiding arrangement 175a–175d is connected on the lower end of the corresponding magazine 151a–151d so that the lower end of the magazine shaft passes perpendicularly over the element-guiding arrangement. On the inside of the element-guiding arrangement 154a–175d the elements, for example climbing irons, follow successively in a chain like manner whereby they collide with one another and can continually reciprocately be pushed along the element-guiding arrangement.

In this way the elements 123*a, b, c, d, e, f, g, h, . . .* are held in the upper element-guiding arrangement 175*a* connected to the magazine 151*a* and corresponding to the aperture 141 with the housing in the core segment, but whereby one of these elements is still perpendicularly positioned in the magazine stack, while the other elements already are held in the element-guiding arrangement 175*a* in a chain-like manner. The other element-guiding arrangement 175*b* that corresponds to the aperture 143 with the housing in the core segment, runs practically coincident, parallel and below the upper element-guiding arrangement 175*b* and leads with its right end to the lower end of the other magazine 151*b* of the first structural component. Below this element-guiding arrangement 175*b* are the elements 125*a*, 125*b*, 125*c*, 125*d*, . . . held one behind the other.

The structural component with the two magazines 151*c* and 151*d* carries the two other element-guiding arrangements, of these the element-guiding arrangement 175*c* is connected at is right end, as seen in FIGS. 7 and 8, with the lower end of the magazine 151*c*. In this magazine and the element-guiding arrangement 175*c*, the elements 124*a, b, c, d, . . .* are held in a manner as previously described.

The other element-guiding arrangement 175*d* of this second structural component runs exactly parallel and beneath the guiding arrangement 175*c* and is connected at the lower end of the other magazine 151*d* in a similar manner. This element-guiding arrangement 175*d* holds the elements 126*a, b, c, . . .*, which are to be successively inserted in the correspond aperture 144 in the core segment.

Figure 6:
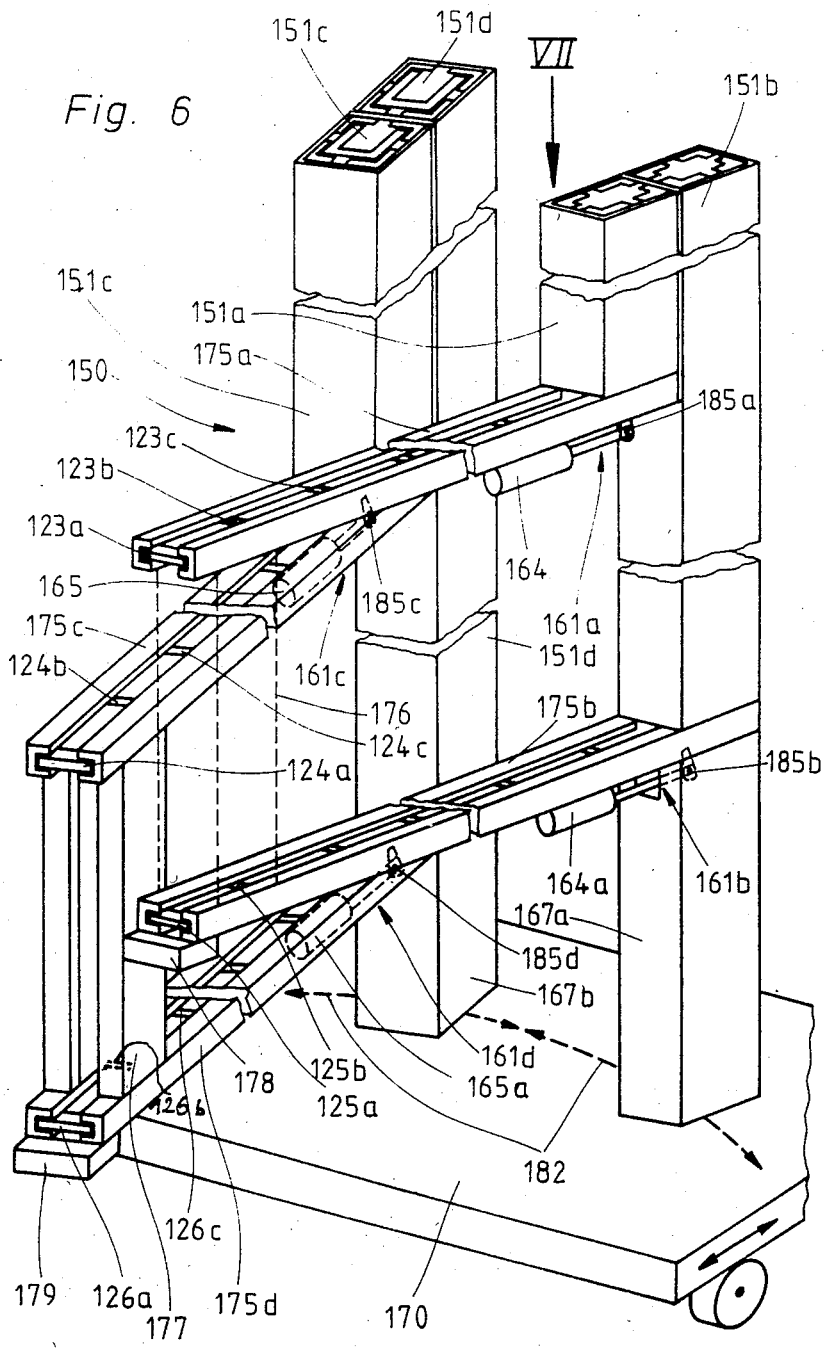
FIG. 6 is a perspective view of an element inserting apparatus for the molding apparatus pursuant to a second embodiment.

In the FIG. 6 it is only schematically indicated that in the first structural component the two element-guiding arrangements 175*a* and 175*b* are perpendicularly supported by a vertical strut 176, just as the other two element-guiding arrangements 175*c* and 175*d* are supported by a vertical strut 177. The lowermost guiding arrangement 175*b* of 175*d* of each structural component can moreover on its left free end, as seen in FIGS. 7 and 8, carry a bumper 178 or 179 that is elastically yielding and can absorb shocks and compensate for variations.

Each individual element-guiding arrangement 175*a*–175*d* is maneuverable to the mold core with its left end, as seen in FIGS. 7 and 8, and is provided at this end, as seen in FIG. 6, a discharge opening for the there at any given time situated elements 123*a*, 125*a*, 124*b*, 126*a*.

Each element-guiding arrangement 175*a*–175*d* has a for example longitudinal through-going open guide channel, or by another not-illustrated embodiment a guide channel closed to the outside. This guide channel has a width and heighth corresponding substantially to the width or heighth of an element, for example climbing irons or stirrups. The bottom plane of each element-guiding arrangement 175*a*–175*d* runs thereby to the heighth of the elements situated lowermost in the stack of the magazines 151*a*–151*d*, whereby this bottom plane extends into a respective magazine and there forms the bottom of the magazine and the lower support surface for the magazine stack. This goes in particular from FIG. 8 for the element-guiding arrangement 175*a* and 175*b* which are shown there in section. As is also seen from FIG. 8, this bottom has a slot formed opening 180*a*, 180*b*, that is significant for the pick-off attachment 161 of the pick-off and inserting device 160, which is yet to be described.

While according to the second embodiment illustrated in FIGS. 6 through 9 each individual element-guiding arrangement 175*a*–175*d* is made of two longitudinally running U-shaped moldings whose shanks are oriented relatively horizontal and toward one another. FIG. 10 illustrates a removed embodiment thereof in which, instead of these U-shaped moldings, two-sided longitudinally running angle moldings 181*a*, 181*b* are shown. Also hereby, each element-guiding arrangement 175*a*–175*d* is so far open that one can oversee the inside and also have quick access to the elements held therein, this being advantageous for maintenance and in case of disturbances.

By another not-illustrated embodiment, the element-guiding arrangement is constructed with a closed somewhat boxshaped profile that cannot be seen into.

Each element-guiding arrangement 175*a*–175*d* is fixedly fastened with its corresponding magazine 151*a*–151*d*. These construct in this manner a unit and can for example be fashioned as a welded construction.

The individual magazines 151*a*–151*d* can in a simple manner be built with an angular profile by placing them at an angle to one another, so as to already extend and to hold the individual elements of the vertical stack in alignment. This is particularly illustrated in FIGS. 6 and 7. The gap between the angular profiles can be opened, so that one can have a good view from outside into each magazine 151*a*–151*d* and also so that one can have quick access in the case of any possible disruptions.

What one can particularly see from FIG. 6, is that the two magazines 151*a*, 151*b* of the first assembly are displaced in the vertical direction. The lowermost end of the foremost magazine 151*a* lies with a distinct distance above the lower end of the other, rearmost magazine 151*b*, whereby the distance is provided to be the distance along each step line between the under one another arranged apertures 141, 143 in the core segment.

The second assembly has corresponding relationships. The lowermost end of the foremost magazine 151*c* runs underneath the lower end of the magazine 151*a*, nevertheless above the lowermost end of the magazine 151*b* of the first assembly. The lowermost end of the rearmost magazine 151*d* of the second assembly runs underneath the lowermost end of the magazines 151*c* and 151*b*.

In this manner is thus the element inserting apparatus 150 formed, that for each individual housing in the area of the aperture 141–144 of the core segment is provided an independent corresponding magazine 151*a*–151*d* together with an element-guiding arrangement 175*a*–175*d*.

The first assembly is supported on the sliding carriage 170 by a carrier 167*a* and the second assembly is supported on the sliding carriage 170 by a carrier 167*b*. Not illustrated is an embodiment in which each individual assembly is adjustable in heighth relative to the sliding carriage 170.

As is indicated in FIG. 6 by dashed arrow 182 and is visible in FIG. 7, both assemblies 151*a*, 151*b* on the one hand or 151*c*, 151*d* on the other and, and advanced by the sliding carriage 170, are pivotally held along a curved path within an approximately horizontal plane. Thereby the first assembly 151*a*, 151*b* with its two guiding arrangements 175*a*, 175*b*, as well as the second assembly 151*c*, 151*d* with its guiding arrangements 175*c*, 175*d* are aligned along running radial lines, preferably symmetric to one another, as are shown in FIG. 7 by dashed line. By pivotal setting of the two assemblies along the curved path of arrow 182 an exact installation on differing diameters of core segments is possible. The sliding carriage 170 carries for each assembly a curved segment piece 183*a*, 183*b* along which the respective assemblies sitting on their carrier 177*a* or 177*b* are pivotally settable. Each curved segment piece 183*a*, 183*b* has for example a curved shaped slot 184*a*, 184*b* along which a pivotal setting is possible and a fixing in the set angle setting is made possible by screws (FIG. 7).

Each magazine 151*a*–151*d* has a corresponding pick-off attachment 161*a*–161*d*, which is provided in the area of the lowermost end of the magazines 151*a*–151*d*. As is particularly shown in FIG. 6, each pick-off attachment 161*a*–161*d* is underneath its respective element-guiding arrangement 175*a*–175*d* in the area of the right end thereof, and is arranged and held thereon.

The pick-off attachment 161*a*–161*d* is the same for each individual magazine 151*a*–151*d*. It has for each magazine 151*a*–151*d* a translation drive in the form of for example a pneumatic or preferably hydraulic working cylinder 164, 164*a* for the first assembly and 165, 165*a* for the second assembly. Each working cylinder moves a hook 185*a*–185*d* back and forth in a horizontal direction by way of its piston rod. Each hook 185*a*–185*d* finds itself in the area of the lowermost end of the corresponding magazine 151*a*–151*d* and reaches therethrough the corresponding, somewhat slot-formed opening 180*a*, 180*b*, which in FIG. 8 is shown for the hooks 185*a*, 185*b* of the magazines 151*a* or 151*b*. The respective hooks 185*a*–185*d* reach perpendicular to the longitudinal axis of the respective magazines 151*a*–151*d* into the lowermost end thereof, whereby the hooks 185*a*–185*d* can hook into an element, behind the cross-piece of the element, in the stack of a respective magazine 151*a*–151*d* by movement to the right as shown in FIG. 8.

FIG. 8 illustrates that the hook 185*a* that is driven under the lowermost element 123*c* in the magazine 181*a* and hooked into this element 123*c* behind the cross-piece. By a movement to the left in FIG. 8 of the hook 185*a* the lowermost element 123*c* is pulled out of the magazine 151*a* and is pushed into the element-guiding arrangement 175*a*, whereby at the same time the elements already laying in the guiding arrangement 175*a* are pushed the distance of one element length. The left end, as seen in FIGS. 6–8, of the element-guiding arrangement 175*a* has a discharge opening from which the there located element 123*a* is discharged from the element-guiding 175*a* and completely pushed therefrom, and in this way through the aperture 141 of the core segment and into the housing.

The relationships are the same respecting the rearmost magazine 151*b* of the first assembly. By this magazine also, the hook 185*b* grasps behind the lowermost element 125*d* of the magazine stack so that by pushing the hook 185*b* to the left in FIG. 8 over a length of an element 125*d*, the element 125*d* is pulled out of the vertical stack and removed from the magazine 151*b* and pushed into the element-guiding arrangement 175*b*.

Figures 9, 10, 12:
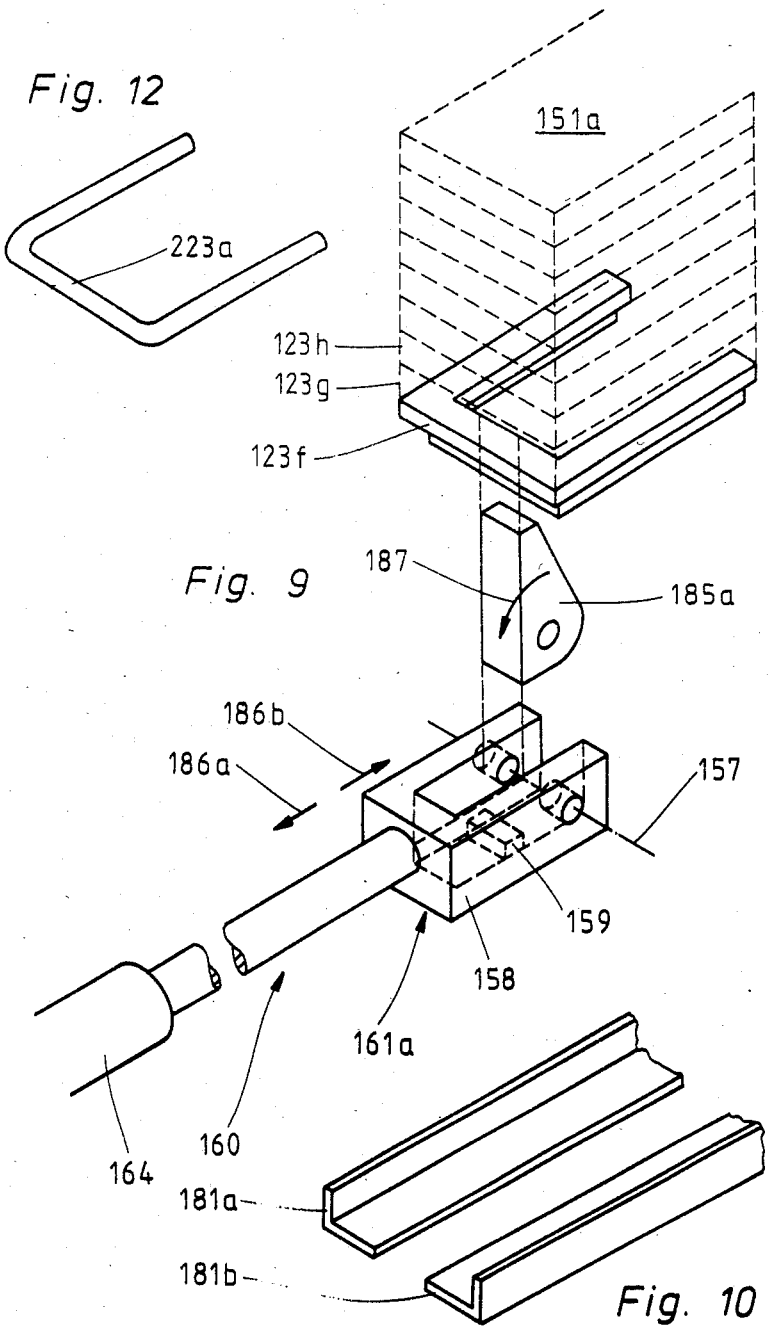
FIG. 9 is an exploded view of the lower portion of a magazine and a pick-off attachment of the element inserting apparatus pursuant to the second embodiment in FIGS. 6 through 8.
FIG. 10 is a perspective view of the discharge end of the element-guiding apparatus according to a modification of the embodiments in FIGS. 6 through 8.
FIG. 12 is a view perspective view of a stirrup for the element inserting apparatus of FIG. 11.

A better view of this pick-off arrangement 161*a* is in FIG. 9 because it illustrates further details thereof. One can see that the hook 185*a* is slideable over at least the length of an element 123*f* in the corresponding stroke direction indicated by arrow 186*a* which is the direction toward the not-illustrated mold core, whereby the lowermost 123*f* is pulled out of a magazine 151*a* in the direction 186*a* and pushed into the guiding arrangement. Then the hook 185*a* is movable in a no-load stroke opposite to the arrow 186*a* in the direction of arrow 186*b* back into its exit position. With this no-load stroke movement the hook can pass under the lowermost element, e.g. the element 123*f*, in the magazine 151*a*. There the hook 185*a* is pivotable in the direction of arrow 187 about a horizontal shaft 157 mounted on a bracket 158 on which the piston rod of the working cylinder 164 is attached. After this tipping motion in the direction of arrow 187 the hook 185*a* by means of a not-illustrated spring can automatically be released to swing back into the working position illustrated in FIG. 9. Such a rocker-hook which can freely tip in the direction of arrow 187 and is untippable in a direction opposite to 187, is well known. In the illustrated embodiment of FIG. 9, this untippability is achieved by way of a stopper 159 provided forwardly in the bracket 158 at a distance from the horizontal axis 157. The hook 185 contacts this stopper by movement opposite to arrow 187 and is prevented from tipping.

When in the course of the production cycle the elements 123*a*, 125*a* are to be automatically brought in over the first assembly and the elements 124*a*, 126*a* are to be automatically brought in by the second assembly simultaneously through all four apertures 141–144 by means of the element inserting apparatus 150, then by engaging the working cylinder 173 the sliding carriage 170 together with the thereon resting two assemblies is driven in a horizontal direction toward the core segment until the position according to FIG. 7 is reached, where the joint discharge openings of the individual element-guiding arrangements 175*a*–175*d* stand at the heighth of the corresponding apertures 141–144. Then the working cylinder 164, 164*a* (first assembly) and 165, 165*a* (second assembly) are simultaneously actuated to drive through the stroke movement in the direction of arrow 186*a* (FIG. 9). Thereby the respective hooks 185*a*–185*d* pull the element at the lowermost end of the respective magazine 151*a*–151*d* out of the magazine stack and move it into the inside of the element-guiding arrangement 175*a*–175*d*. In the element-guiding arrangement 175*a*–175*d* the individual elements lay in a nearly chain like manner behind one another and abut against one another. In the area of the ends which align with the apertures 141–144, the stroke movement causes the foremost element 123*a*, 125*a* (first assembly) or 124*a*, 126*a* (second assembly) to be pushed out. Therefore, by this two-step arrangement all four elements are simultaneously brought into the core segment. After this the working cylinder 173 is actuated opposite thereto in a return stroke motion causing the sliding carriage 170 to be moved in a horizontal direction away from the core segment, and indeed as far away as possible. Simultaneously or overlapping therewith all the working cylinders 164, 164*a* and 165, 165*a* and their individual pick-off attachments 161*a*–161*d* are activated for no-load stroke movement opposite to arrow 186*b*. Thereby the respective hook 185*a* tips around the axis 157 in the direction 187 when it contacts the now lowermost lying elements in the magazine 151*a*–151*d* so that the hook 185*a* can pass under this lowermost element until the withdrawing position for the hook 185 is again reached by way of the working cylinder 164. The hook 185 then stands, for example automatically by springs, counter weights or the like, again in the working position according to FIG. 9 whereby it now grasps behind the lowermost lying element in the magazine 151*a* in the area of the crosspiece between the two sides. The respective pick-off attachment 161a–161d is now ready for the next cycle.

The length of the individual element-guiding arrangement 175a–175d is selected so that no part of the element inserting apparatus 150, whether the magazine 151a–151d in addition to the guiding arrangement 175a–175d, reaches to come in contact with the machine or a part thereof, e.g. the lift carriage of the machine, during the remaining manufacturing operations. In their return position the element-guiding arrangements 175a–175d thus find themselves outside of the machine area.

It is evident for the activation of the element inserting apparatus 150 only two additional control functions are necessary, namely controlling the working cylinder 173 on the one hand and controlling the individual working cylinder 164, 164a or 165, 165a of the pick-off attachment 161a–161d on the other hand. Control technology makes this of no difficulty. The element inserting apparatus 150 thereby makes possible a fully automatic problem free process cycle. It is moreover uncomplicated and cost-effective, easy to maintain and makes possible, in addition, the elimination disruption due to the quick access available at all times.

Figure 11:
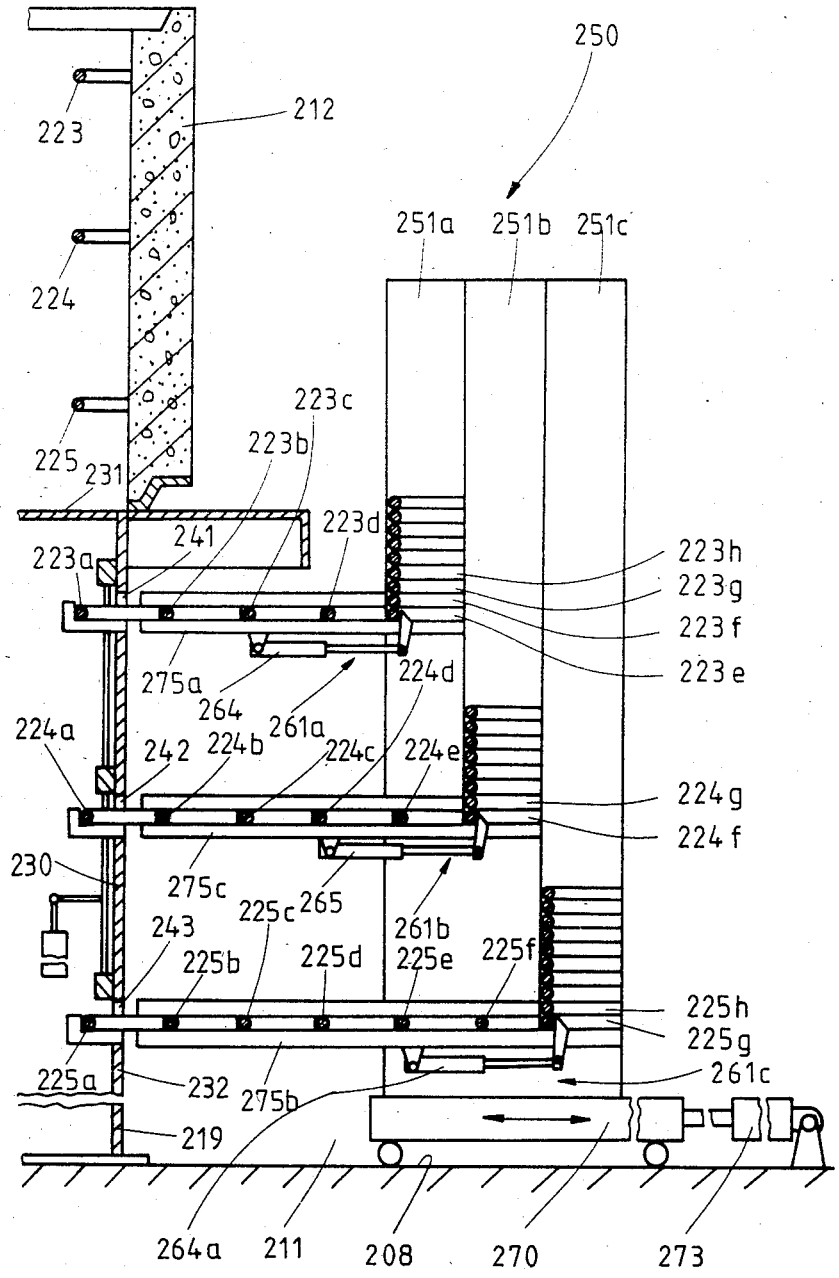
FIG. 11 is a partially sectioned side view, similar to FIG. 8, of a portion of the molding apparatus with a mold core with an element inserting apparatus, in a condition showing the insertion of the climbing irons in the mold core, according to a third embodiment.

A third embodiment is illustrated in FIG. 11. For parts which correspond to those described in the first embodiment, the reference numbers have been raised by a factor of 200.

The element inserting apparatus 250 according to FIG. 11 is specifically for a single step arrangement with several, here for example three, housings with apertures 241–243 in the core segment 230, whereby these apertures 241–243 are all placed on a common jacket line below one another.

In addition, the element inserting apparatus 250 is intended for elements in the form of stirrups. FIG. 12 particularly shows one such stirrup 223a. These stirrups are made of a pipe bent in a U shape.

Also with this element inserting apparatus 250, each aperture 241–243 has a corresponding independent magazine 251a–251c on hand, whereby all three magazines 251a –251c are fastened together behind one another in a single assembly and are fixedly attached to a lowerly provided sliding carriage 270. The lowermost ends of the individual magazines 251a, c, b are graduated. The lowermost end of the foremost 251a runs uppermost, the magazine 251b following therebehind runs underneath the lowermost ends of the first magazine, and the end of the rearmost magazine 251c runs underneath the lowermost end of the middle magazine 251b.

As with the second embodiment, each magazine 251a–251c of the third embodiment has a corresponding independent element-guiding arrangement 275a–275c that is fixedly attached thereto. The element-guiding arrangement 275a–275c is constructed in the same way as in the second embodiment, each is provided with a pick-off attachment 261a–c that has a hook on the lowermost magazine end which is driven by means of the working cylinder.

In the uppermost element-guiding arrangement 275a the individual elements 223a–223d are held in a somewhat chain-link manner and abut one another, whereby the element 223d connects to the element 223e which is the lowermost laying element in the magazine 251a, and on which the vertical stack of elements 223f, g, h, . . . follow.

In the middle element-guiding arrangement 275c the elements 224a–224e are held, whereby the element 224e connects with the lowermost element of the magazine 251b namely element 224f, over which the vertical stack of elements 224g etc. follow.

In the lowermost element-guiding arrangement 275b lay the individual elements 225a–225f, whereby the element 225f connects with the lowermost element 225g in the magazine 251c, over this element 225g the vertical stack of elements 225h, etc. are located.

In the operation of the manufacturing process the element 223a, 224a, 225a are brought through the apertures 241–243 and into the corresponding housings of the core segment 230 by way of the sliding carriage 270 being driven by a working cylinder 273 in the horizontal direction to a position illustrated in FIG. 11. If the stroke of each individual pick-off attachment 261a–261c is sufficiently large the left, as seen in FIG. 11, discharge opening of each element-guiding arrangement 275a–275c can also travel a smaller distance from the core segment 230. Hereafter, the individual pick-off attachments 261a–261c are activated by actuating the working cylinders 264, 264a, 265 to travel through the stroke movement. Thereby, by means of the pick-off attachment 261a–261c the lowermost element 223e or 225d or 224f in in the magazine 251a–251c is pulled out the vertical stack and pulled into the corresponding guiding arrangement 275a–275c. Simultaneously, likewise by the pick-off attachment 261a–261c, all the elements abut one another in the guiding arrangement 275a–275c, therein the at the time frontmost element 223a, 224a, 225a is pushed out of the discharge opening and through the aperture 241–243 in the core segment 230 into the there located housing. Thereafter by controlling the working cylinder 273, the entire element inserting apparatus 250 in FIG. 11 can be pulled back to the right, with overlap or timed switching of the working cylinder of the pick-off attachment 261a–261c.

Figure 13:
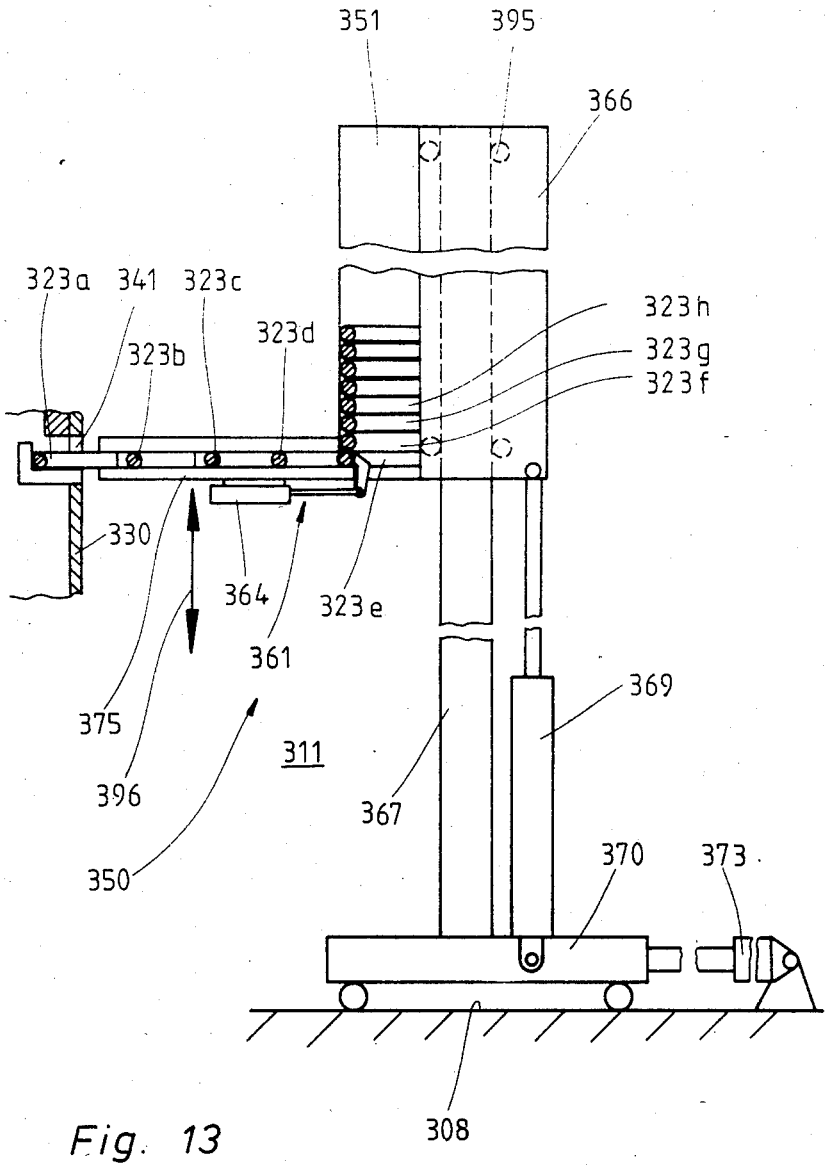
FIG. 13 is a partially sectioned side view similar to FIG. 11, with an element inserting apparatus according to a fourth embodiment, showing the insertion of the stirrups.

FIG. 13 illustrates a fourth embodiment wherein the illustrated element inserting apparatus 350 is also, as with the third embodiment in FIG. 11, for the equal one step arrangement provided with a number of housings and apertures 341 which are located on a common step line on the core segment 330 and are situated under one another. The element inserting apparatus 350 has one individual magazine 351 with an element-guiding arrangement 375 connected thereto. Both are formed and connected together as in the previous embodiments. On the lowermost end of the magazine 351 is a pick-off attachment 361 identical to those described in the previous embodiments.

The magazine 351 is vertically adjustable by a lifting drive, that here includes for example a pneumatic or hydraulic working cylinder 369, relative to the sliding carriage 370 along a vertical carrier 367. The carrier 367 serves at the same time as a vertical guide, that can be constructed as a roller guide, for the guide rollers 395 which are indicated by dashed lines. In another not-illustrated embodiment the guide is constructed as a sliding guide. The magazine 351 is not turnable relative to the carrier 367, rather the holder of the magazine 351 and the carrier 367 are securely connected by a nut and spring or similar elements between the holder and the carrier 367.

By means of the working cylinder 369, the magazine 351 is vertically adjustable in intervals in the direction of the arrow 396, for example from the toward the bottom and opposite thereto from the bottom toward the top, and of course in intervals respective to the distance between two consecutive housings with apertures in the core segment 330.

For activation the element inserting apparatus 350 is driven in a horizontal direction to the core segment 330 by means of the working cylinder 373. The magazine 351 along with the element-guiding arrangement 375 can correspond with the heighth of the upper aperture 341 in the core segment 330. By activation of the pick-off attachment 361 in the described manner the next element 323 in the area of this upper aperture 341 is brought in. After that the magazine 351 is pushed a step downward in the direction of arrow 396 by means of the working cylinder 369, and again by activation of the pick-off attachment 361 now the element **323*b* is brought into the aperture under the aperture 341 in the core segment 330. In this manner each of the housings in the core segment 330 is provided for one after the other from the single magazine 351**.

It is understood that when one can also work stepwise from the bottom toward the top, whereby in this way as a first working cycle the magazine 351 is moved into the lowermost setting by way of the working cylinder 369 and after this is moved step by step toward the top.

The element inserting apparatus 350 according to the fourth embodiment in FIG. 13 is the simplest with respect to construction and cost. This can however give the necessary output despite the necessary differing control functions for the vertical lifting movement and despite the necessity that the magazine 351 must be refilled more often.

While has the invention has been illustrated described as embodied in a method and apparatus for molding a plurality of projecting elements in a concrete article, it is not intended to be limited to the details shown, since various modifications and structural changes may be made without departing in way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims:

I claim:

1. A method for molding concrete articles with one or more projecting elements, comprising the steps of: providing a mold core having a core segment and a remaining portion, the core segment having one or more housings corresponding to the one or more projecting elements, and said housings being movable relative to the remaining portion of said mold core into a release position and a closed position; providing a mold jacket relative to said mold core so as to form a mold cavity; starting a first work cycle by moving said core segment into the closed position, and bringing in and holding the one or more elements in said housings; pouring concrete into the mold cavity to form the article; completing the first work cycle after hardening of the concrete with the elements therein, by moving the core segment into the release position and removing the concrete article from said mold cavity; and automatically bringing projecting elements for a next work cycle into said housings of said core segment during a time interval between said first work cycle and said next work cycle and in timed overlap with the working steps which may occur during this time interval.

2. A method as defined in claim 1, wherein said step of completing said first work cycle includes removing the completed article by pushing it out.

3. A method as defined in claim 1, wherein said providing a core step includes providing the core segment with one or more housings corresponding to one or more projecting elements formed as climbing elements.

4. A method as defined in claim 1, wherein said step of automatically bringing projecting elements into the housings of the core segment includes bringing the projecting elements into the housings while transporting away the completed concrete article of the first work cycle.

5. A method as defined in claim 1; and further comprising the step of bringing in a lower sleeve to be lowered into said mold cavity for a concrete article to be made in said next work cycle, said step of bringing in a lower sleeve occurring while said step of automatically bringing in projecting elements into the core segment takes place.

6. A method as defined in claim 1, wherein said step of automatically bringing projecting elements into said core segment includes bringing in said elements individually one after another.

7. A method as defined in claim 1, wherein said step of automatically bringing projecting elements into said core segment includes simultaneously bringing in the elements in groups.

8. A method as defined in claim 1; and further comprising the step of providing a magazine for holding the elements in alignment with the housings of the core segment, and said step of automatically bringing projecting elements into said housings includes taking the elements from said magazine and bringing them into said housings.

9. A method as defined in claim 1; and further comprising the steps of moving the core segment together with the projecting elements therein into the release position, bringing in a lower sleeve into said mold cavity, and moving the core segment together with the projecting elements back into the closed position.

10. A method as defined in claim 1; and further comprising the steps of moving said core segment together with the projecting elements out of said closed position into said release position, bringing a lower sleeve and a reinforcing body into the mold cavity, and moving said core segment together with the projecting elements back to said closed position.

11. A method as defined in claim 1; and further comprising the steps of moving said core segment together with the projecting elements out of said closed position into said release position, bringing a reinforcing body into said mold cavity, and moving said core segment together with the projecting elements back into said closed position.

12. A method as defined in claim 11, wherein said step of bringing in a reinforcing body includes bringing in a reinforcing ring.

13. An apparatus for producing concrete articles with at least one projecting element, comprising: a molding arrangement having an inner mold core and an outer mold jacket, said mold core having a mounting fixture for cementing the projecting elements from the inside in the concrete article to be formed; and an automatically working element inserting mechanism located in a working area neighboring the molding arrangement, and oriented at least substantially to the height of said inner mold core for inserting the projecting elements into said inner mold core and thereby into the concrete article.

14. An apparatus as defined in claim 13, wherein said mounting fixture is formed for cementing the projecting elements formed as climbing elements.

15. An apparatus as defined in claim 13, wherein said element inserting mechanism includes at least one magazine in which the individual projecting elements are storeable lying one above the other.

16. An apparatus as defined in claim 15, wherein said mold core includes a core segment having at least one housing, and said element inserting mechanism including at least one pick-off and inserting device, by means of which the at least one element is removed from said magazine, and is properly aligned, with a respective housing in said core segment of said mold core so as to be insertable in said corresponding housing from outside of said mold core.

17. An apparatus as defined in claim 16, wherein said pick-off and inserting device includes at least one pick-off attachment formed so as to reach inside of said magazine, grasp at least one element therein and remove it therefrom.

18. An apparatus as defined in claim 17, wherein said pick-off and inserting device which aligns the grasped element, is formed so as to be able to insert the element in a corresponding housing of said core segment.

19. An apparatus as defined in claim 18, wherein said pick-off attachment includes at least one pair of simultaneously actuatable grippers.

20. An apparatus as defined in claim 17, wherein said pick-off attachment includes a holder and a discharge device for each individual element.

21. An apparatus as defined in claim 20, wherein said discharge device is a working cylinder.

22. An apparatus as defined in claim 21, wherein said working cylinder is a hydraulic cylinder.

23. An apparatus as defined in claim 21, wherein said working cylinder is a pneumatic cylinder.

24. An apparatus as defined in claim 20; and further comprising a carrier formed so as to support said holders.

25. An apparatus as defined in claim 24, wherein said holders are fixedly connected to said carrier.

26. An apparatus as defined in claim 24, wherein said mold core has a longitudinal center axis, said holders are slideably connected to said carrier; and further comprising a guide member which is approximately parallel to said longitudinal center axis of the mold core for guiding said holders, and a position drive means for sliding said holders.

27. An apparatus as defined in claim 26, wherein said position drive means includes a working cylinder.

28. An apparatus as defined in claim 27, wherein said working cylinder is a hydraulic cylinder.

29. An apparatus as defined in claim 27, wherein said working cylinder is a pneumatic cylinder.

30. An apparatus as defined in claim 20; and further comprising a carrier formed so as to support at least one said magazine.

31. An apparatus as defined in claim 30, wherein said at least one magazine is fixedly connected to said carrier.

32. An apparatus as defined in claim 30, wherein said mold core has a longitudinal center axis, and said at least one magazine is slideably connected to said carrier; and further comprising a guide member at least substantially parallel to said longitudinal center axis of said mold core for guiding said magazine, and a position drive means for sliding said magazine.

33. An apparatus as defined in claim 32, wherein said position drive means includes a working cylinder.

34. An apparatus as defined in claim 17, wherein said pick-off attachment includes at least one gripper having closable clamps so as to securely hold the element when closed, and so as to release the element when opened after the element has been inserted in a corresponding housing of said core segment.

35. An apparatus as defined in claim 34; and further comprising a clamping device formed so as to hold the elements without sliding in their respective housings, said clamps of said gripper being openable only after said clamping device has been activated to hold the elements.

36. An apparatus as defined in claim 24, wherein said mold core has a longitudinal center axis, said element inserting mechanism including at least one slideable carriage substantially transverse to said longitudinal center axis of said mold core, and a drive means for sliding said slideable carriage toward the mold core into an inserting position and back away from the molding arrangement to a waiting position.

37. An apparatus as defined in claim 36, wherein said slideable carriage is at a right angle to said longitudinal center axis.

38. An apparatus as defined in claim 36, wherein said slideable carriage drive means includes a working cylinder.

39. An apparatus as defined in claim 38, wherein said working cylinder is a hydraulic cylinder.

40. An apparatus as defined in claim 38, wherein said working cylinder is a pneumatic cylinder.

41. An apparatus as defined in claim 36, wherein said carrier is located on said slideable carriage.

42. An apparatus as defined in claim 36, wherein said at least one magazine is arranged so as to be angularly positionable in relation to said mold core within a diametral plane of said mold core.

43. An apparatus as defined in claim 36, wherein said at least one pick-off attachment is arranged so as to be angularly positionable relative to said mold core within a diametral plane of said mold core.

44. An apparatus as defined in claim 36, wherein said slideable carriage is arranged so as to be angularly positionable relative to said mold core within a diametrical plane of said mold core.

45. An apparatus as defined in claim 36, wherein said at least one magazine and said at least one pick-off attachment are arranged so as to be angularly positionable with respect to said mold core within a diametral plane of said mold core.

46. An apparatus as defined in claim 36, wherein said at least one magazine and said slideable carriage are arranged so as to be angularly positionable with respect to said mold core within a diametral plane of said mold core.

47. An apparatus as defined in claim 36, wherein said at least one pick-off attachment and said slideable carriage are arranged so as to be angularly positionable with respect to said mold core within a diametral plane of said mold core.

48. An apparatus as defined in claim 36, wherein said at least one magazine, said at least one pick-off attachment and said slideable carriage are arranged so as to be angularly positionable with respect to said mold core within a diametral plane of said mold core.

49. An apparatus as defined in claim 15, wherein said magazine has a vertical axis and a lowermost end; and further comprising an individual element-guiding arrangement for said individual magazine, said element-guiding arrangement being substantially horizontal and transverse to said magazine vertical axis, said element-guiding arrangement having a first end and a second end, said first end being connected to said lowermost end of said magazine and said second end directed toward said mold core and having a discharge opening for the elements to be discharged, and said element-guiding arrangement also having an inside in which the elements are located in a chain-like manner one after the other and abutting one another.

50. An apparatus as defined in claim 49, wherein said element-guiding arrangement includes a longitudinal guide channel which is closed to the outside and which has a width and a height that substantially correspond to the width and height of an element.

51. An apparatus as defined in claim 49, wherein said element-guiding arrangement includes a longitudinal guide channel that is longitudinally open and has a width and a height that substantially correspond to a width and a height of the elements.

52. An apparatus as defined in claim 49, wherein the elements are stacked in said magazine, and said element-guiding arrangement has a bottom plane and is constructed so as to move so that said bottom plane corresponds to the lower most located element in the stack.

53. An apparatus as defined in claim 49, wherein said element-guiding arrangement includes two longitudinally running angle moldings having arms that are substantially horizontal and aligned with one another.

54. An apparatus as defined in claim 49, wherein said element-guiding arrangement includes two longitudinally running U-shaped moldings having arms that are substantially horizontal and aligned with one another.

55. An apparatus as defined in claim 49, wherein said element-guiding arrangement is fixedly connected to a corresponding magazine.

56. An apparatus as defined in claim 49, wherein said element inserting mechanism includes an individual corresponding magazine for each individual housing.

57. An apparatus as defined in claim 56, wherein each said magazine of said element inserting mechanism is provided with its own element-guiding arrangement.

58. An apparatus as defined in claim 15, wherein said housings of said core segment provide a single path arrangement of the elements; and further comprising a plurality of such magazines, said magazines which hold the elements for setting in a path line being joined in a single assembly and arranged one behind the other.

59. An apparatus as defined in claim 15, wherein said housings of said core segment provide a double path arrangement for the elements; and further comprising a plurality of such magazines, said magazines, that hold the elements in the proper orientation to be set in a path line, being joined in separate assemblies and located one behind the other.

60. An apparatus as defined in claim 59, wherein said double path arrangement has a first path line and a second path line, each said path line having at least one housing, each said housing of said first path line having a corresponding magazine, said corresponding magazines being combined in a first assembly, said housings of said second path line each having corresponding magazines grouped into a second assembly, said magazines in each said assembly being grouped behind one another, each said assembly further including an element-guiding arrangement corresponding to each magazine and arranged one above the other.

61. An apparatus as defined in claim 60; and further comprising a slideable carriage, and each said assembly having a carrier with a lower end, said carrier being attached at said lower end to said slideable carriage and being arranged to hold said assemblies.

62. An apparatus as defined in claim 61, wherein each said element-guiding arrangement of each of said assemblies is arranged along radial lines.

63. An apparatus as defined in claim 62, wherein said element-guiding arrangements run symmetrical to one another along said radial lines.

64. An apparatus as defined in claim 61, wherein each said assembly is held vertically adjustable relative to said slideable carriage.

65. An apparatus as defined in claim 61, wherein each said assembly is held so as to be pivotable along a curved path substantially horizontal relative to said slideable carriage.

66. An apparatus as defined in claim 61, wherein each said assembly is held so as to be vertically adjustable and pivotable along a curved path within a substantially horizontal plane relative to said slideable carriage.

67. An apparatus as defined in claim 66; and further comprising a curved segment piece for said assembly, each said curved segment piece being connected to said slideable carriage so that each said assembly along with its respective carrier is pivotable thereon.

68. An apparatus as defined in claim 58, wherein said single path arrangement has a common path line with a plurality of housings on said core segment, said pluralitiy of housings having a corresponding plurality of magazines grouped into a single assembly and arranged one behind the other, each magazine of said plurality of magazines having a lower most end, said single assembly further including a plurality of separate element-guiding arrangements; one such arrangement being connected to said lowermost end of each said magazine, said element-guiding arrangements being arranged parallel to one another and running at graduated intervals underneath one another.

69. An apparatus as defined in claim 68; and further comprising a sliding carriage, said single assembly being fixedly connected to said sliding carriage.

70. An apparatus as defined in claim 58, wherein said single path arrangement has a common path line on said core segment with a plurality of said housings, said assembly including a single said magazine with a said element-guiding arrangement connected thereto; and further comprising a vertical carrier formed to carry said assembly in a vertically adjustable manner, and a lifting drive means for vertically adjusting said assembly.

71. An apparatus as defined in claim 70, wherein said lifting drive means includes a working cylinder.

72. An apparatus as defined in claim 70, wherein said housings are spaced vertically above one another, and said lifting drive is provided so as to move said single magazine stepwise downwardly along said common path line over the distance between said housings.

73. An apparatus as defined in claim 70, wherein said housings are spaced at a distance one above the other along said common path line, and said lifting drive is provided so as to move said single magazine upwardly in a stepwise manner along said path line over said distance between said housings.

74. An apparatus as defined in claim 70, wherein said housings are spaced at a distance above one another along said common path line, and said lifting drive is provided so as to move said magazine stepwise both upwardly and downwardly over the distance between said housings.

75. An apparatus as defined in claim 17, wherein each said at least one magazine has a lowermost end, and is provided with its own ndividual said pick-off attachment connected in the area of said lowermost end.

76. An apparatus as defined in claim 75, wherein the elements each have a crosspiece, each said magazine having a vertical longitudinal axis and a stack of the elements therein, and said pick-off attachment including a hook transverse to said vertical magazine axis and formed so as to pass under a lowermost element in the stack of elements and catch the crosspiece of the element.

77. An apparatus as defined in claim 76; and further comprising a translation drive means for moving said hook so that it grasps the element.

78. An apparatus as defined in claim 77, wherein said translation drive means includes a working cylinder.

79. An apparatus as defined in claim 77, wherein said translation drive means is provided so as to move said hook so that it pulls an element out of said magazine at least a distance equal to the length of an element and in the direction of the mold core, said translation drive means also having a no-load stroke in which the hook is moved opposite to the above direction into a discharge position.

80. An apparatus as defined in claim 79, wherein said hook is a rocker hook which is automatically tippable in the no-load stroke movement as it passes under a lowermost element in said magazine, and is untippable in the direction opposite thereto in which the element is removed from said magazine.

81. An apparatus as defined in claim 49, wherein each said pick-off attachment is located underneath a respective element-guiding arrangement and connected thereto.

* * * * *